US010882680B2

(12) United States Patent
Yonai et al.

(10) Patent No.: US 10,882,680 B2
(45) Date of Patent: Jan. 5, 2021

(54) CONTAINER FOR BOTH CRYOPRESERVATION AND TRANSPORTATION

(71) Applicants: TAIYO NIPPON SANSO CORPORATION, Tokyo (JP); MEDICEO CORPORATION, Tokyo (JP)

(72) Inventors: Hajime Yonai, Tokyo (JP); Tsuyoshi Kunii, Tokyo (JP); Yoshiaki Tomofuji, Tokyo (JP)

(73) Assignees: TAIYO NIPPON SANSO CORPORATION, Tokyo (JP); MEDICEO CORPORATION, Tokyo (JP)

( * ) Notice: Subject to any disclaimer, the term of this patent is extended or adjusted under 35 U.S.C. 154(b) by 275 days.

(21) Appl. No.: 16/043,562

(22) Filed: Jul. 24, 2018

(65) Prior Publication Data

US 2020/0031559 A1 Jan. 30, 2020

(51) Int. Cl.
*B65D 81/20* (2006.01)
*B65D 81/38* (2006.01)
(Continued)

(52) U.S. Cl.
CPC ..... *B65D 81/20* (2013.01); *B65D 25/02* (2013.01); *B65D 25/18* (2013.01); *B65D 81/38* (2013.01); *B65D 25/005* (2013.01)

(58) Field of Classification Search
CPC .... B65D 81/20; B65D 81/38; B65D 81/3806; B65D 25/18; B65D 25/02; B65D 25/005; F25D 3/107
(Continued)

(56) References Cited

U.S. PATENT DOCUMENTS 3,108,840 A * 10/1963 Conrad ..... F25D 25/00 312/400
3,948,406 A * 4/1976 Papanicolaou ..... F17C 3/06 220/560.15
(Continued)

FOREIGN PATENT DOCUMENTS

JP 48-15586 2/1973
JP 59-68645 4/1984
(Continued)

OTHER PUBLICATIONS

S. Yoshimura, "Refrigeration", JSRAE, vol. 91, No. 1069, 2016, pp. 789-793 (w/ translation).
(Continued)

*Primary Examiner* — Chun Hoi Cheung
*Assistant Examiner* — Brijesh V. Patel
(74) *Attorney, Agent, or Firm* — Nixon & Vanderhye P.C.

(57) ABSTRACT

A container for both cryopreservation and transportation including a thermal insulating container which has an inlet-outlet port for a substance to be stored and a lid for opening and closing the inlet-outlet port at the top thereof, a storage section which has a bottomed tubular shape, is fixed in the thermal insulating container and capable of taking in and out the substance stored from the inlet-outlet port, and a wave-suppression plate which is positioned laterally in a space between the storage section and an inner wall of the thermal insulating container, and suppresses waving of the cryogenic liquefied gas in a liquid state accumulated in the space between the storage section and the inner wall of the thermal insulating container.

11 Claims, 6 Drawing Sheets

(51) Int. Cl.
*B65D 25/18* (2006.01)
*B65D 25/02* (2006.01)
*B65D 25/00* (2006.01)

(58) Field of Classification Search
USPC ..... 220/560.01–560.15, 592.01–592.28; 435/289.1, 1.1, 1.2, 284.1
See application file for complete search history.

(56) References Cited

U.S. PATENT DOCUMENTS 3,978,808 A * 9/1976 Cuneo ..... B63B 25/16 114/74 A
4,481,779 A * 11/1984 Barthel ..... F17C 3/08 220/560.12
4,489,569 A 12/1984 Sitte
4,498,304 A * 2/1985 Guilhem ..... F17C 13/126 220/560.12
4,551,992 A 11/1985 Sitie et al.
4,729,494 A 3/1988 Peillon et al.
5,355,684 A * 10/1994 Guice ..... A01N 1/02 62/457.2
5,370,258 A * 12/1994 Fair ..... A47G 19/2211 220/501
5,419,143 A * 5/1995 Leonard ..... B01L 7/04 62/46.3
6,119,465 A 9/2000 Mullens et al.
7,111,750 B2 * 9/2006 Gulati ..... F17C 3/00 220/560.04
7,581,407 B1 * 9/2009 Romanos ..... F17C 3/085 220/560.04
8,857,650 B2 * 10/2014 Skovholt ..... F17C 3/022 220/560.12
2002/0084277 A1 * 7/2002 Mullens ..... F17C 3/08 220/560.04
2005/0066682 A1 * 3/2005 Anthony ..... F25D 3/107 62/293
2011/0168722 A1 * 7/2011 Baudat ..... F17C 3/04 220/560.12
2012/0000918 A1 * 1/2012 Deane ..... B65D 81/3811 220/592.2
2012/0297797 A1 * 11/2012 Cognard ..... A61B 10/0096 62/51.1
2013/0091890 A1 * 4/2013 Schryver ..... B01L 7/50 62/440
2013/0183751 A1 * 7/2013 Kobayashi ..... B65G 47/74 435/287.3
2013/0232998 A1 * 9/2013 Ward ..... A01N 1/0268 62/51.1

FOREIGN PATENT DOCUMENTS

JP 4-6859 2/1992
JP 6-71435 10/1994
JP 6-84799 10/1994
JP 2007-271279 10/2007
JP 2009-47335 3/2009
JP 2012-177663 9/2012
JP 2013-220059 10/2013

OTHER PUBLICATIONS

Notice of Allowance for JP2016-020360 dated Dec. 19, 2017 (w/ translation).

* cited by examiner

CONTAINER FOR BOTH CRYOPRESERVATION AND TRANSPORTATION

BACKGROUND OF THE INVENTION

Field of the Invention

The present invention relates to a container for both cryopreservation and transport which can store pharmaceuticals and the like in a frozen state and can also be used for transportation.

Description of Related Art

As a method of storing and transporting pharmaceuticals and the like in a frozen state, it is conceivable to store substance such as preserved specimens in a thermal insulating container accumulating cryogenic liquefied gas such as liquid nitrogen.

However, there is a danger that liquid nitrogen and the like may leak during transportation of the thermal insulating container in which the substance is stored.

Therefore, a "cryopreservation container" which does not have such risk of leakage is proposed, for example, in Patent Document 1.

The cryopreservation container disclosed in Patent Document 1 includes a thermal insulating container having a sample inlet-outlet port which can be opened and closed freely at the top, a sample storage case stored in the thermal insulating container from the sample inlet-outlet port, and an impregnation material impregnated with a cryogenic liquefied gas and is held in the thermal insulating container, so as to maintain cryogenic gas phase atmosphere in the thermal insulating container by the liquefied gas impregnated in the impregnation material (see claim 1 of Patent Document 1).

PRIOR ART DOCUMENTS

Patent Literature

Patent Document 1 Japanese Unexamined Patent Application, First Publication No. 2007-271279

SUMMARY OF THE INVENTION

Problem to be Solved by the Invention

In Patent Document 1, the interior of the thermal insulating container is maintained in a cryogenic gas phase atmosphere by placing the impregnation material impregnated with the cryogenic liquefied gas such as liquid nitrogen in the thermal insulating container.

For this reason, there is no danger of liquid leakage since no liquid is accumulated.

However, the remaining amount of the cryogenic liquefied gas in the impregnation material impregnated with the cryogenic liquefied gas cannot be visually confirmed. Accordingly, it is necessary to estimate the cryopreservable storage time by measuring the weight with, for example, a weighing scale. There is a problem that it is troublesome to confirm the cryopreservable storage time.

In addition, when the cryogenic liquefied gas such as liquid nitrogen is replenished, it is necessary to take out the sample storage case and transfer it to another cryopreservation container once, so that it is troublesome to replenish the cryogenic liquefied gas.

The above-mentioned problems are caused by impregnating the impregnation material with the cryogenic liquefied gas. Accordingly, it is conceivable that the above-mentioned problems can be solved by storing the cryogenic liquefied gas such as liquid nitrogen or the like in a liquid state in a separate region from the substance to be stored in the thermal insulating container so as not to come into contact with the substance to be stored and closing an opening of a part in which the cryogenic liquefied gas is accumulated with something like an internal stopper so as to prevent the cryogenic liquefied gas from leaking.

However, when the cryogenic liquefied gas is sealed in the thermal insulating container, there is a problem that cold (cryogenic liquefied gas in a gaseous state) does not go toward the substance stored, and the substance stored is insufficiently cooled.

On the other hand, when the cryogenic liquefied gas is accumulated in a non-sealed state, there is a risk that droplets of cryogenic liquefied gas in a liquid state adhere to the substance stored, such as pharmaceuticals or the like during transportation and contaminate the substance stored.

The present invention has been made in order to solve such problems, and it is an object of the present invention to provide a container for both cryopreservation and transportation in which a cryogenic liquefied gas can be accumulated in a liquid state in a thermal insulating container, and a substance stored can be sufficiently cooled without coming into contact with the cryogenic liquefied gas, and contamination by the cryogenic liquefied gas.

Means for Solving the Problem

In order to solve the problems, the present invention provides the following container for both cryopreservation and transportation.

(1) A container for both cryopreservation and transportation including a thermal insulating container which has an inlet-outlet port for a substance to be stored and a lid for opening and closing the inlet-outlet port at the top thereof, a storage section which has a bottomed tubular shape, is fixed in the thermal insulating container and capable of taking in and out the substance stored from the inlet-outlet port, anal a wave-suppression plate which is positioned laterally in a space between the storage section and an inner wall of the thermal insulating container, and suppresses waving of the cryogenic liquefied gas in a liquid state accumulated in the space between the storage section and the inner wall of the thermal insulating container.

(2) The container for both cryopreservation and transportation according to (1), wherein the container further includes a baffle plate which is provided on the inner wall of the thermal insulating container to prevent the cryogenic liquefied gas from entering the storage section.

(3) The container for both cryopreservation and transportation according to (1) or (2), wherein the wave-suppression plate is fixed on an outer wall of the storage section.

(4) The container for both cryopreservation and transportation according to any one of (1) to (3), wherein the storage section is fixed with a fixing unit in a state of being placed on a bottom portion of the thermal insulating container, the fixing unit includes a plate member standing from the bottom portion of the thermal insulating container, and a connecting and fixing member which connects and fixes an upper end portion of the plate member with an upper end portion of the storage section.

(5) The container for both cryopreservation and transportation according to any one of (1) to (4), wherein the container further includes a filling tube of which one end side is positioned in a space between the thermal insulating container and the storage section and the other end side is positioned outside the thermal insulating container and fills the space with the cryogenic liquefied gas.

Effects of the Invention

According to the present invention, the container for both cryopreservation and transportation includes a thermal insulating container which has an inlet-outlet port for a substance to be stored and a lid for opening and closing the inlet-outlet port at the top thereof, a storage section which has a bottomed tubular shape, is fixed in the thermal insulating container and capable of taking in and out the substance stored from the inlet-outlet port, and a wave-suppression plate which is positioned laterally in a space between the storage section and an inner wall of the thermal insulating container, and suppresses waving of the cryogenic liquefied gas in a liquid state accumulated in the space between the storage section and the inner wall of the thermal insulating container.

Accordingly, the cryogenic liquefied gas can be accumulated in a liquid state in the thermal insulating container. In addition, the substance stored can be sufficiently cooled without coming into contact with the cryogenic liquefied gas, and contamination due to the cryogenic liquefied gas.

DETAILED DESCRIPTION OF THE INVENTION

Figure 1:
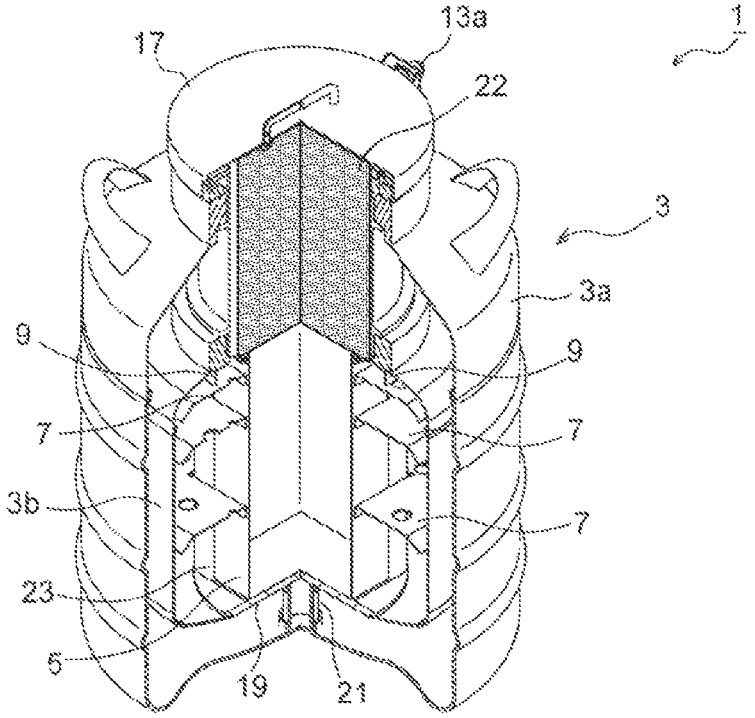
FIG. 1 is a perspective view including a partial cross section of a container for both cryopreservation and transportation according to one embodiment of the present invention.
Figure 2A:
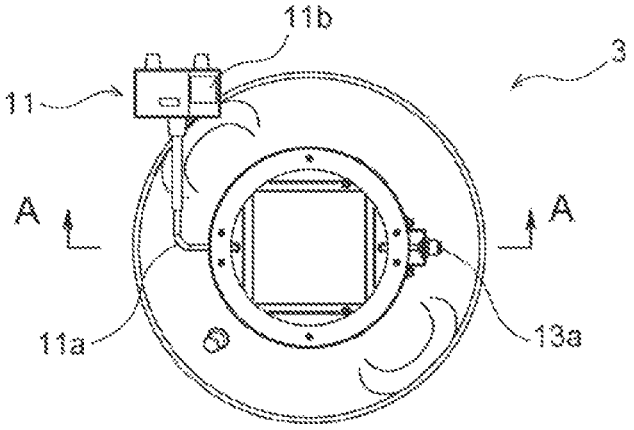
FIG. 2A is a plan view of a container for both cryopreservation and transportation shown in FIG. 1 in a state where a lid and a thermal insulating material are removed.
Figure 2B:
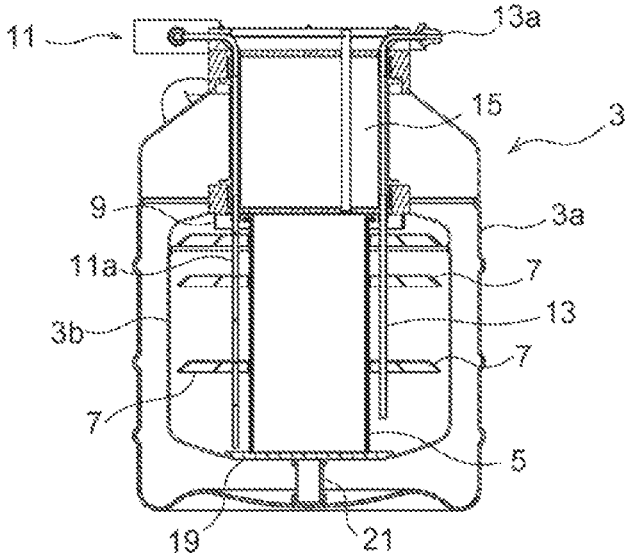
FIG. 2B is a cross-sectional view of a container for both cryopreservation and transportation shown in FIG. 2A taken along the line A-A of FIG. 2A.

As shown in FIGS. 1 and 2, a container 1 for both cryopreservation and transportation according to one embodiment of the present invention includes a thermal insulating container 3, a storage section provided in the thermal insulating container 3 to store substance such as pharmaceuticals, a wave-suppression plate 7 provided between an inner wall 3*b* of the thermal insulating container 3 and an outer wall of the storage section 5, a baffle plate 9 provided on the inner wall 3*b* of the thermal insulating container 3 to prevent liquid nitrogen to enter the storage section 5, a liquid level gauge 11, and a filing tube 13 for the cryogenic liquefied gas.

Hereinafter, each element constituting the container 1 for both cryopreservation and transportation will be described in detail.

In the following description, liquid nitrogen will be described as an example of cryogenic liquefied gas. Moreover, as the cryogenic liquefied gas, liquefied helium, liquefied argon or the like can also be used.

<Thermal Insulating Container>

The thermal insulating container 3 has an inlet-outlet port 15 for the substance at the top, and a lid 17 which can open and close the inlet-outlet port 15 is provided at the inlet-outlet port 15. The thermal insulating container 3 has a vacuum double-wall structure including an outer wall 3*a* and an inner wall 3*b*.

As shown in FIGS. 1 and 2, a bottom portion of the inner wall 3*b* is a circular thick bottom portion 19 having a thickness larger than the other portions. A support member 21 is provided under the thick bottom portion 19, and the thick bottom portion 19 is supported by a support member 21.

The inside of the thermal insulating container 3 (the inside of the inner wall 3*b*) is hollow, and the hollow portion is provided with a storage section 5 for storing substances such as pharmaceuticals.

Moreover, as will be described later, a space between the inner wall 3*b* of the thermal insulating container 3 and an outer wall of the storage section 5 serves as an accumulation section for the liquid nitrogen.

<Storage Section>

Figure 3:
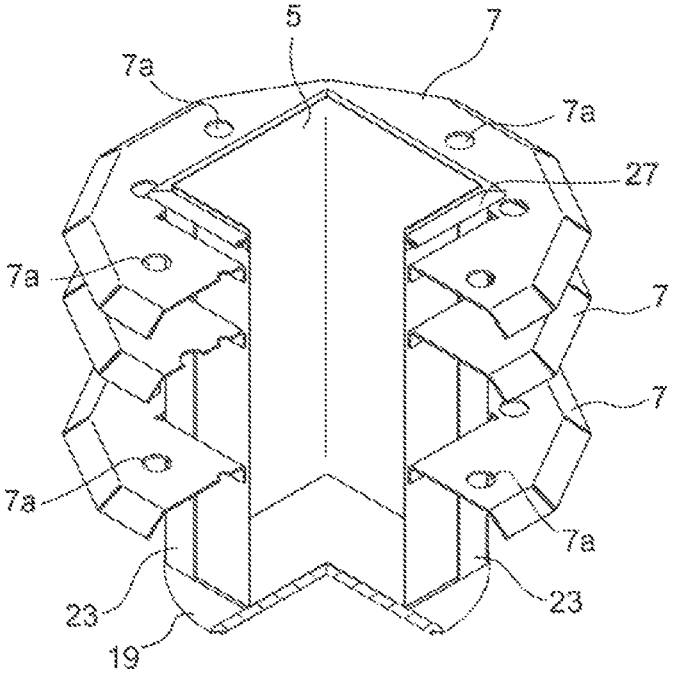
FIG. 3 is an explanatory view of a storage section and a wave-suppression plate provided in the container for both cryopreservation and transportation shown in FIG. 1.

The storage section 5 is positioned in a hollow portion in the inner wall 3*b* of the thermal insulating container 3 (see FIGS. 1 and 2) and is formed by a square cylinder having a bottom and an opening at the upper portion, which is made of stainless steel (see FIG. 3). A heat insulating material 22 fixed to the lid 17 is disposed between an opening of the storage section 5 and the inlet-outlet port 15 for substance to be stored when the lid 17 is attached (see FIG. 1).

Moreover, the storage section 5 is fixed in the thermal insulating container 3. In this case, when the storage section 5 is fixed to the heat insulating container 3 by welding or the like, for example, it is considered that the storage section 5 may be deformed or broken due to thermal shrinkage with the cryogenic liquefied gas such as liquid nitrogen.

Therefore, the storage section 5 is fixed with a fixing unit as explained below in a state where the storage section 5 is placed on the thick bottom portion 19 of the heat insulating container 3 in the present embodiment.

Figure 5:
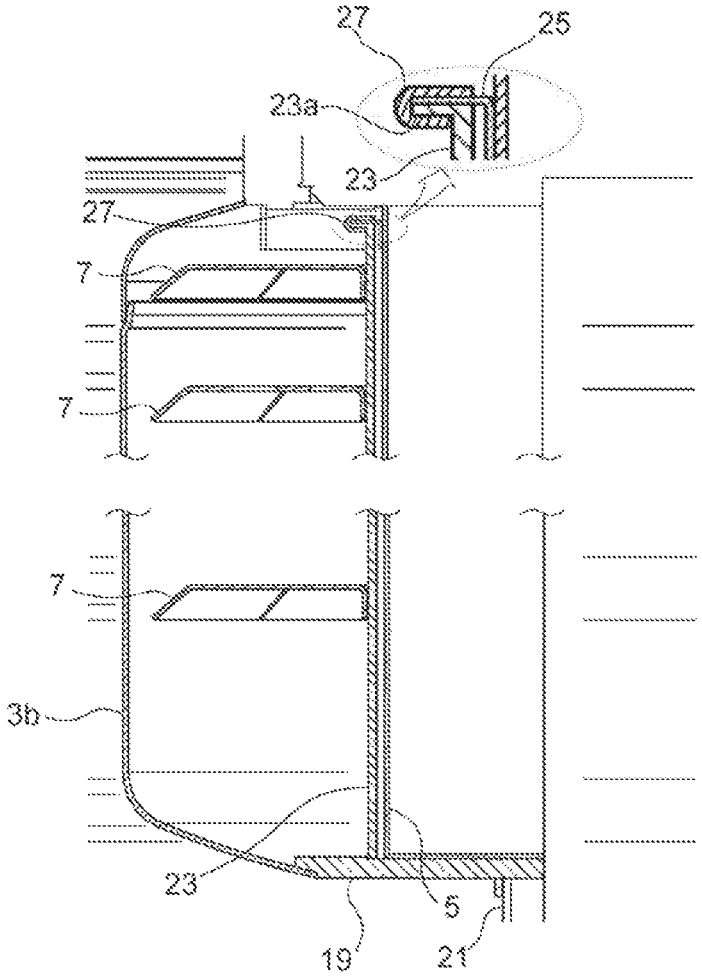
FIG. 5 is an explanatory view for a method of fixing the storage section of the container for both cryopreservation and transportation shown in FIG. 1, and is an enlarged view of a portion B surrounded by a circle of a broken line in FIG. 4.

Hereinafter, a fixing method of the storage portion 5 by the fixing unit will be described with reference to FIGS. 3 and 5.

Plate members 23 which are made of an angle material, and positioned so as to surround the four corners of the storage section 5 stand and are fixed to the thick bottom portion 19 by welding. The plate member 23 has a bent portion 23*a* which bends outwardly at the upper end thereof.

On the other hand, a frame member 25 having an L-shaped cross section is welded to the outer peripheral portion near the upper end of the storage section 5. Then, the bent portion 23*a* and the frame member 25 are fasten tightly with a connecting and fixing member 27 such that the bent portion 23*a* and the frame member 25 are sandwiched from above and below to integrate them. That is, the storage section 5 is fixed in the thermal insulating container 3 by the plate member 23 and the connecting and fixing member 27.

<Wave-Suppression Plate>

The wave-suppression plate 7 is positioned horizontally between the storage section 5 and the inner wall 3*b* of the thermal insulating container 3. The wave-suppression plate 7 suppress the generation of wave of the liquid nitrogen accumulated in the space between the storage section 5 and the inner wall 3*b* of the thermal insulating container 3.

As shown in FIG. 3, three wave-suppression plates 7 are provided so as to surround the storage section 5. The wave-suppression plate 7 is fixed to the plate member 23.

Regarding the positioning of the wave-suppression plate 7 in the vertical direction, the central wave-suppression plate is located at the level of the liquid surface when the liquid nitrogen is filled by 100%, the uppermost wave-suppression plate is located at the level of the liquid surface when the liquid nitrogen is filled by 125%, and the lowest wave-suppression plate is located at the level of the liquid surface when the liquid nitrogen is filled by 50%.

Moreover, the liquid nitrogen easily enters the storage portion 5 when the liquid surface is highest, and the liquid is waved. Accordingly, the wave-suppression plate 7 is provided in accordance with the highest position of the liquid surface height. Thereby, it is possible to effectively suppress waves when the liquid surface position is highest.

The number of the wave-suppression plate 7 may be appropriately set according to the height of the interior of the thermal insulating container 3 and the height of the storage section 5.

As shown in FIG. 3, the wave-suppression plate 7 has a circular shape according to the inner shape of the thermal insulating container 3, and the peripheral portion thereof is bent downwardly. The rigidity of the wave-suppression plate 7 is enhanced by downwardly bending the peripheral edge. It is also possible to suppress lateral movement of the liquid nitrogen.

Moreover, when the diameter of the wave-suppression plate 7 is small, since there is little need to enhance the rigidity, the wave-suppression plate 7 may be a flat plate.

In addition, a plurality of gas flow holes 7*a* are provided in the wave-suppression plate 7. Thereby, a large amount of vaporized nitrogen gas generated at the time of filling passes through and easily goes upward.

<Baffle Plate>

Figure 4A:
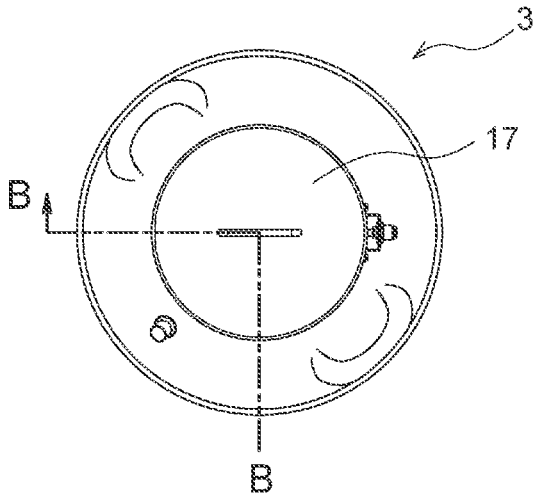
FIG. 4A is a plan view showing the interior structure of the container for both cryopreservation and transportation shown in FIG. 1.
Figure 4B:
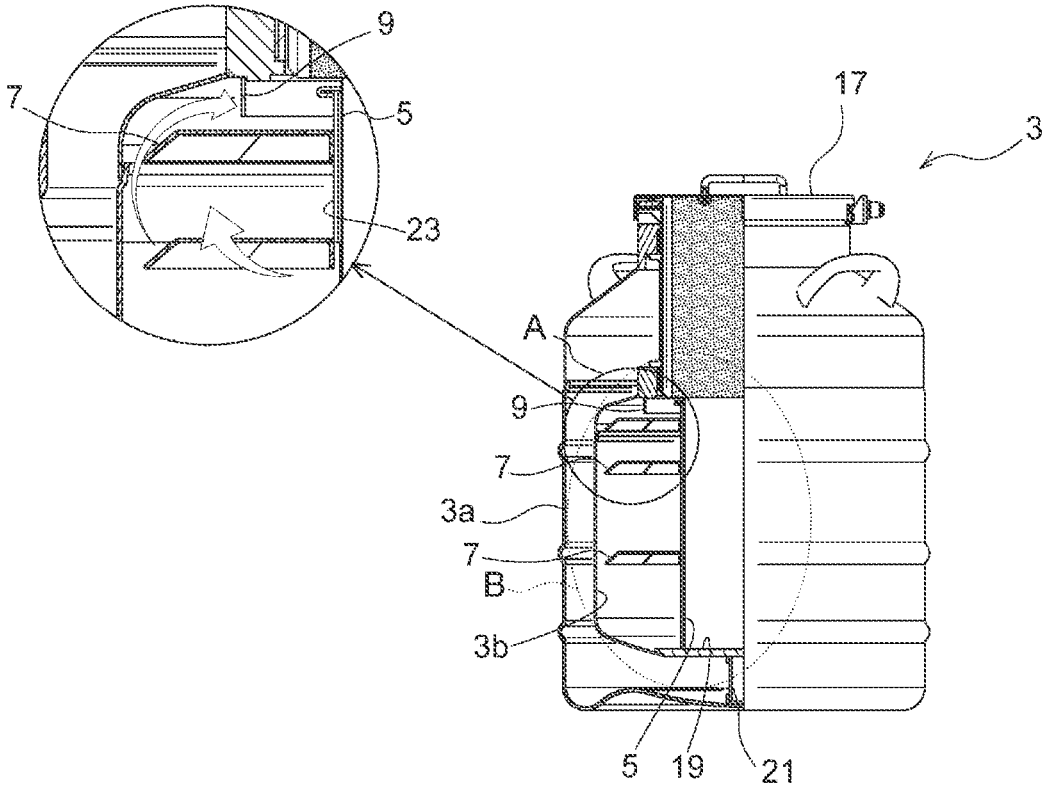
FIG. 4B is a cross-sectional view showing the interior structure of the container for both cryopreservation and transportation shown in FIG. 1 taken along the line B-B of FIG. 4A.

The baffle plate 9 is provided on the upper portion of the inner 3*b* of the heat insulating container 3 and prevents the liquid nitrogen from entering the storage section 5. That is, as shown in the enlarged view of FIG. 4B, the baffle plate prevents the liquid nitrogen from moving on the inner wall 3*b* of the heat insulating container 3 and entering into the storage portion 5 due to the lateral shaking.

In order to effectively exhibit such a function, it is preferable that the baffle plate 9 be provided so as to surround the outer peripheral of the storage section 5 and to downwardly extend from the upper end of the opening of the storage section 5.

<Liquid Level Gauge>

The liquid level gauge 11 detects the liquid level of the liquid nitrogen in the heat insulating container 3. The liquid level gauge 11 includes a liquid level sensor 11*a* extending into the thermal insulating container 3 through the inlet-outlet port 15, and a display portion 11 *b* which is mounted on the upper portion of the thermal insulating container 3 and displays the liquid level.

<Filling Tube>

The filling tube 13 injects the liquid nitrogen from the outside. One end side of the filling tube 13 is positioned in a space between the thermal insulating container 3 and the storage section 5, and the other end side thereof is positioned in the upper end part of the thermal insulating container 3. The other end side serves as an injection port 13*a* for the liquid nitrogen.

In the container 1 for both cryopreservation and transportation of the present embodiment configured as described above, the liquid nitrogen is injected into the space (liquid nitrogen storage portion) between the outer wall of the storage section 5 and the inner wall 3*b* of the thermal insulating container 3. Then, the substance such as pharmaceuticals is stored in the storage section 5, and the lid 17 is closed. Thereby, it is possible to store and transport the substance.

Since the upper end portion of the storage section 5 is opened and connected with the liquid nitrogen storage portion in a state where the substance to be stored is stored, the gasified liquid nitrogen can enter the storage portion 5 from the upper opening of the storage section 5, sufficient cooling effect can be obtained.

Further, it is possible to prevent the liquid surface of the liquid nitrogen from waving in the vertical direction by providing the wave-suppression plate 7, and thereby it is also possible to prevent the splash due to the waving from entering through the opening of the storage portion 5.

As described above, the container 1 for both cryopreservation and transportation of this embodiment can prevent contamination of the substance stored by the liquid nitrogen and sufficiently cool the substance stored.

Further, in the container 1 for both cryopreservation and transportation of this embodiment, since the remaining amount of the liquid nitrogen can be visually confirmed by the liquid level gauge 11, and the liquid nitrogen can be injected from the filling tube 13. Accordingly, the liquid nitrogen can be easily replenished.

Figure 6:
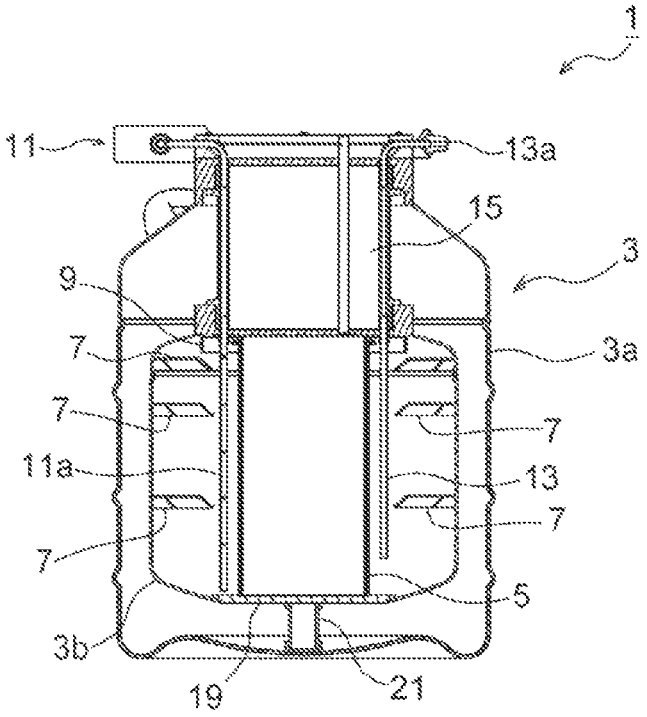
FIG. 6 is an explanatory view of another embodiment of the container for both cryopreservation and transportation according to the present invention.

In the above embodiment, the wave-suppression plates 7 are fixed to the side of the storage section 5, that is, the wave-suppression plates 7 are fixed to the plate members 23 so as to surround the storage portion 5. However, as shown in FIG. 6, the wave-suppression plate 7 may be fixed to the inner wall 3*b* of the thermal insulating container 3. Moreover, the wave-suppression plate 7 may be directly fixed to the inner wall 3*b* of the thermal insulating container 3. Otherwise, another member such as a bracket is fixed to the inner wall 3*b* and the wave-suppression plate 7 may be fixed to the bracket.

Further, the wave-suppression plate 7 may be positioned so as not to be fixed but floating on the liquid surface of the liquid nitrogen like a drop lid. When the wave-suppression plate 7 is not s necessary to make the wave-suppression plate 7 with a material which withstands the cold of the liquid nitrogen and is floating on the liquid nitrogen. For example, the wave-suppression plate 7 may be foamed using polyurethane or the like in this case.

The wave-suppression plate 7 is positioned in the horizontal direction in the above embodiment. As long as it is possible to suppress the upward and downward movement of the liquid nitrogen, the wave-suppression plate 7 is not necessarily horizontal but may be oblique.

As described above, the wave-suppression plate 7 in the above-described embodiment is a plate which spreads in the lateral direction and prevents the liquid surface from waving. However, in addition to this wave-suppression plate 7, a partition plate which divides the liquid nitrogen storage section in circumferential direction may be erected in the longitudinal direction. By providing the partition plate, the movement of the liquid nitrogen in the lateral direction is restricted, thereby making it possible to suppress the waving more effectively.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCE NUMERAL

1 container for both cryopreservation and transportation
3 thermal insulating container
3*a* outer wall
3*b* inner wall
5 storage section
4 wave-suppression plate
7*a* gas flow hole
9 baffle plate
11 liquid level gauge
11*a* liquid level sensor
11*b* display portion
13 filing tube
13*a* injection port
15 inlet-outlet port
17 lid
19 thick bottom portion
21 support member
22 heat insulating material
23 plate member
23*a* bent portion
25 frame member
27 connecting and fixing member

What is claimed is:

1. A container for both cryopreservation and transportation including a thermal insulating container which has an inlet-outlet port for a substance to be stored and a lid for opening and closing the inlet-outlet port at the top thereof, a storage section having a bottomed tubular shape which is fixed in the thermal insulating container and capable of taking in and out the substance stored from the inlet-outlet port, and a wave-suppression plate which is positioned laterally in a space between the storage section and an inner wall of the thermal insulating container, and suppresses waving of a cryogenic liquefied gas in a liquid state accumulated in the space between the storage section and the inner wall of the thermal insulating container.

2. The container for both cryopreservation and transportation according to claim 1, wherein the container further includes a baffle plate which is provided on the inner wall of the thermal insulating container to prevent the cryogenic liquefied gas from entering the storage section.

3. The container for both cryopreservation and transportation according to claim 2, wherein the wave-suppression plate is positioned outside of the storage section.

4. The container for both cryopreservation and transportation according to claim 2, wherein the storage section is fixed with a fixing unit when placed on a bottom portion of the thermal insulating container, the fixing unit includes a plate member standing from the bottom portion of the thermal insulating container, and a connecting and fixing member which connects and fixes an upper end portion of the plate member with an upper end portion of the storage section.

5. The container for both cryopreservation and transportation according to claim 2, wherein the container further includes a filling tube of which one end side is positioned in the space between the storage section and the inner wall of the thermal insulating container and the other end side is positioned outside the thermal insulating container and fills the space with the cryogenic liquefied gas.

6. The container for both cryopreservation and transportation according to claim 1, wherein the wave-suppression plate is positioned outside of the storage section.

7. The container for both cryopreservation and transportation according to claim 6, wherein the storage section is fixed with a fixing unit when placed on a bottom portion of the thermal insulating container, the fixing unit includes a plate member standing from the bottom portion of the thermal insulating container, and a connecting and fixing member which connects and fixes an upper end portion of the plate member with an upper end portion of the storage section.

8. The container for both cryopreservation and transportation according to claim 6, wherein the container further includes a filling tube of which one end side is positioned in the space between the storage section and the inner wall of the thermal insulating container and the other end side is positioned outside the thermal insulating container and fills the space with the cryogenic liquefied gas.

9. The container for both cryopreservation and transportation according to claim 1, wherein the storage section is fixed with a fixing unit when placed on a bottom portion of the thermal insulating container, the fixing unit includes a plate member standing from the bottom portion of the thermal insulating container, and a connecting and fixing member which connects and fixes an upper end portion of the plate member with an upper end portion of the storage section.

10. The container for both cryopreservation and transportation according to claim 9, wherein the container further includes a filling tube of which one end side is positioned in the space between the storage section and the inner wall of the thermal insulating container and the other end side is positioned outside the thermal insulating container and fills the space with the cryogenic liquefied gas.

11. The container for both cryopreservation and transportation according to claim 1, wherein the container further includes a filling tube of which one end side is positioned in the space between the storage section and the inner wall of the thermal insulating container and the other end side is positioned outside the thermal insulating container and fills the space with the cryogenic liquefied gas.

* * * * *